US005147169A

United States Patent [19]

Miller et al.

[11] Patent Number: 5,147,169

[45] Date of Patent: Sep. 15, 1992

[54] AUTOMATED ENVELOPE HANDLING SYSTEM

[75] Inventors: Lester Miller, Danbury; Szee M. Yao, Norwalk, both of Conn.

[73] Assignee: Agissar Corporation, Stratford, Conn.

[21] Appl. No.: 707,622

[22] Filed: May 30, 1991

Related U.S. Application Data

[63] Continuation of Ser. No. 458,772, Dec. 29, 1989, Pat. No. 5,052,875.

[51] Int. Cl.[5] ..... B65B 43/30

[52] U.S. Cl. ..... 414/403; 198/502.3; 73/DIG. 11; 414/412

[58] Field of Search ..... 198/502.3, 502.4; 414/412, 411, 403; 83/912; 209/576, 577, 597, 598; 901/46, 47; 73/DIG. 11

[56] References Cited

U.S. PATENT DOCUMENTS

| | | | |
|---|---|---|---|
| 4,376,363 | 3/1983 | Russell | 53/381.6 X |
| 4,863,037 | 9/1989 | Stevens et al. | 414/412 X |
| 4,921,388 | 5/1990 | Nelson | 414/412 |
| 4,934,892 | 6/1990 | Smith et al. | 414/412 |

FOREIGN PATENT DOCUMENTS

| | | | |
|---|---|---|---|
| 133112 | 7/1984 | Japan | 198/502.3 |
| 126018 | 6/1987 | Japan | 198/502.3 |
| 31922 | 2/1988 | Japan | 198/502.3 |
| 143110 | 6/1988 | Japan | 198/502.3 |
| 2020615 | 11/1979 | United Kingdom | 198/502.3 |

*Primary Examiner*—Frank E. Werner
*Attorney, Agent, or Firm*—Melvin I. Stoltz

[57] ABSTRACT

By providing a pair of vacuum manifolds positioned on opposite sides of an envelope travel path with the vacuum manifolds being laterally spaced apart, a unique, effective and dependable envelope handling system is achieved whereby the envelope sides are consistently separated and the contents removed therefrom and positioned in a readily accessible channel. Preferably, the envelope handling system also incorporates sensing devices for automatically and separately inspecting each side of the envelope to determine the presence of additional material which should be processed. In this way, any such material is automatically discovered for handling by the operator.

18 Claims, 11 Drawing Sheets

AUTOMATED ENVELOPE HANDLING SYSTEM

This application is a continuation of application Ser. No. 07/458,772, filed Dec. 29, 1989, now U.S. Pat. No. 5,052,875.

TECHNICAL FIELD

This invention relates to envelope or mail handling systems and more particularly to a system for separating pre-slit envelopes and orienting the contents thereof for processing.

BACKGROUND ART

Due to the ever increasing demand by numerous businesses for efficient mail handling equipment, many systems have been developed in an attempt to automatically receive envelopes, slit the envelope open, and present the contents thereof in a manner which is most efficiently handled by an operator. Although these prior art systems have been reasonably efficient in receiving the envelopes and slitting the envelopes open, substantial difficulty has been encountered in separating the slit envelope and presenting the contents thereof reliably and repeatedly in a manner which is easily and conveniently removed by an individual for checking and processing.

Although various prior art systems have been developed to meet the needs of industry, these prior art attempts have been unable to provide an envelope handling system which is capable of repeatedly and reliably separating the pre-slit envelopes and presenting the contents in a manner which is easily reached by the operator for efficient and speedy removal and processing. One typical prior art method is to blow air into the pre-slit envelope in an attempt to enable the operator to reach in and remove the contents therefrom. However, this system has proven to be extremely slow, as well as inefficient in opening the envelope sufficiently for consistent and repeatable access by the operator.

Other prior art systems have employed a vacuum in an attempt to draw the sides of the envelope away from each other while the contents of the envelope are to remain stationary until captured by a track or reached by the operator for removal. One of these prior art vacuum systems employ vacuum ports which are positioned perpendicularly to the line of travel of the envelope in juxtaposed spaced facing relationship to each other. However, in use, it has been found that these prior art systems are incapable of repeatedly, consistently, and reliably maintaining the contents in the desired orientation or properly opening the envelope.

In particular, these prior art vacuum systems have been found to be incapable of drawing only the sides of the envelope, without also adversely affecting the contents thereof. Consequently, both the contents and the envelope side are drawn to the vacuum, causing the contents to be improperly positioned and requiring special attention by the operator. Furthermore, these prior art vacuum systems are extremely noisy, in view of the high level of suction required to draw the envelopes to the vacuum head.

Another common difficulty encountered with the prior art systems is the requirement for special attention by the operator to assure that the envelope has been separated in the precisely desired manner before reaching the end of the conveyor or track. This special attention is required to be certain that part of the envelope contents, such as a statement, check, or informative letter, have not been improperly positioned with one side of the envelope.

In an attempt to address this problem, some prior art systems have incorporated sensors to stop the envelope transfer system if envelope contents are sensed as the envelope passes to waste disposal. However, such systems are totally incapable of stopping the transfer system if some of the envelope contents are removed and another component, such as a check or note is not in the proper orientation and, instead, is positioned with the side of the envelope. In these systems, if the operator fails to observe this improper condition, the contents of the envelope become separated, and processing errors are often incurred.

Therefore it is a principal object of the present invention to provide an automated envelope handling system which is capable of repeatedly, reliably and consistently separating a pre-slit envelope from the contents thereof, and reliably presenting the entire envelope contents in the precisely desired orientation for processing.

Another object of the present invention is to provide an automated envelope handling system having the characteristic features described above, which is capable of operating at a substantially reduced decibel or noise level, thereby providing a system which is comfortable for the operators to use.

Another object of the present invention is to provide an automated envelope handling system having the characteristic features described above, which substantially eliminates mishandling of the envelope contents.

A further object of the present invention is to provide an automated envelope handling system having the characteristic features described above which also provides sensing means for checking the sides of the envelope to determine if any additional papers are attached thereto, thereby indicating the presence of improperly positioned material which should be processed.

Another object of the present invention is to provide an automated envelope handling system having the characteristic features described above which also incorporates automatic shut-off means responsive to the sensing means to terminate the envelope transfer processing whenever an error is detected.

Other and more specific objects will in part be obvious and will in part appear hereinafter.

SUMMARY OF THE INVENTION

The present invention overcomes the prior art drawbacks and shortcomings by providing a uniquely constructed staggered vacuum system in combination with novel envelope sensing means which is able to directly determine the presence or absence of material erroneously channeled with a side of the envelope. By employing the automated handling system of the present invention, it has been found that virtually all of the prior art difficulties and problems are completely eliminated.

In the present invention, the envelope handling system employs vacuum ports or manifolds which are positioned at different, spaced-apart locations along the travel path of the envelope. In this way, substantially improved reliability and efficiency is attained in separating the sides of the pre-slit envelope and preventing the unwanted attachment of the envelope contents to the envelope side. Furthermore, by positioning the face of each vacuum port or manifold at an angle to the envelope travel path, substantial improvement is attained in efficiently separating each side of the envelope from the other and assuring that the contents of the envelope are maintained in the desired orientation.

It has also been found that by employing the vacuum manifold construction of this invention, the level of vacuum required to draw the envelope towards the vacuum port is substantially reduced. As a result, the system employs a substantially lower vacuum level, thereby reducing the noise level caused by the vacuum system. As a result, the entire system operation is performed in a much more comfortable environment for the operator and the surrounding personnel.

The preferred embodiment of the envelope handling system of the present invention also incorporates sensing means for determining whether any material, which should be processed, has been improperly positioned in association with either side of the envelope. In addition, these envelope side sensors are connected to control means for automatically terminating the envelope processing sequence whenever an error has been detected.

The preferred embodiment of the present invention also incorporates a contents sensor for determining the presence of envelope contents which has not been removed. In this preferred embodiment, the contents sensor comprises a conventional photo-detector and light source which provides an output signal whenever the light beam is broken by the passage of the envelope contents between the photo-detector and the light source. If envelope contents is detected, the system automatically stops the envelope transfer belt.

As discussed above, one of the problems encountered with prior art systems is the ability for the envelope contents or part of the contents, such as a note, to be improperly positioned with the envelope side and not be seen by the operator. In such situations, the material is often discarded with the envelope as waste material.

In order to eliminate this prior art drawback and difficulty, the envelope handling system of the present invention incorporates two additional pairs of photo-detectors and light sources associated with each envelope side to directly monitor the envelope side. In this arrangement, a simple on/off photo-detector and light source cannot be used, since the envelope side would continuously break the triggering beam. Consequently, the present invention comprises a variable, adjustable photo-detector which is manually set to read the light source through the envelope side As a result, the sensor effectively monitors the thickness of the side of the envelope, remaining untriggered as long as only the envelope side passes between the photo-detector and the light source.

Any time additional material is sensed with the side of the envelope, the effective thickness of the envelope is greater and the photo-detector will be activated, since the light source beam will be broken. In this condition, an alarm signal is generated and the envelope transfer belt is stopped. As a result, the present invention is capable of determining the presence of additional material in association with either side of the envelope, and automatically causing the envelope handling system to stop, until the material has been removed and properly handled.

By employing the envelope handling system of the present invention, system operators have a dependable and reliable system which automatically stops the envelope transfer belt each and every time any material which should be processed has been sensed as being improperly positioned. Although photo-detectors are preferred, any other optical, electrical or mechanical system can be employed with equal efficacy. Furthermore, this sensor system is preferably employed in conjunction with a substantially improved vacuum manifold system which substantially eliminates envelope misfeeds and repeatedly and reliably positions the envelope contents where desired. In this way, an envelope handling system is attained wherein envelopes are efficiently, reliably and repeatedly processed with optimum speed and efficiency.

The invention accordingly comprises the features of construction, combinations of elements, and arrangement of parts which will be exemplified in the constructions hereinafter set forth, and the scope of the invention will be indicated in the claims.

THE DRAWINGS

For a fuller understanding of the nature and objects of the present invention, reference should be had to the following detailed description taken in connection with the accompanying drawings in which.

DETAILED DESCRIPTION

Figure 1:
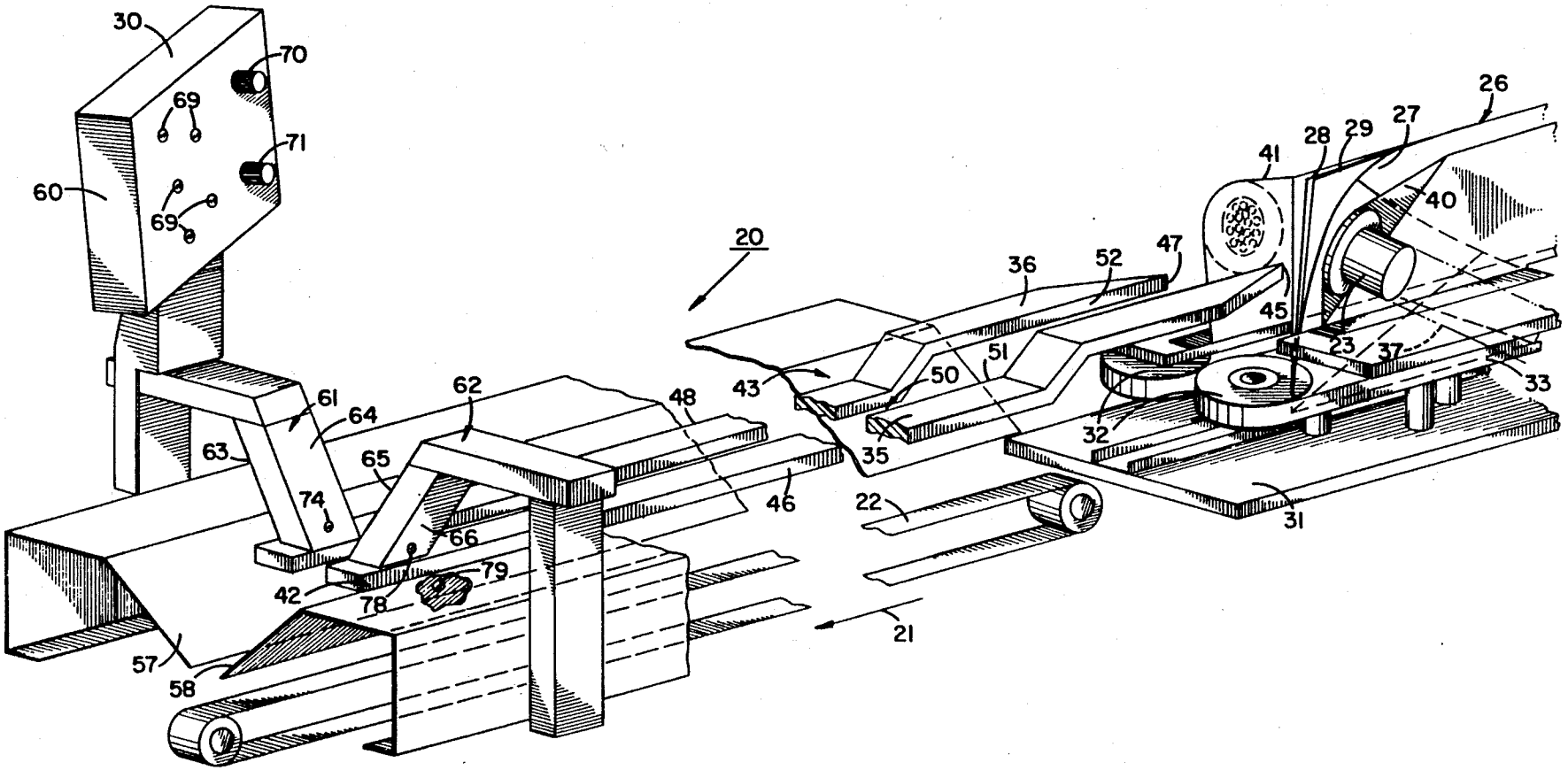
FIG. 1 is a perspective view of the envelope handling system of the present invention, partially broken away, showing a pre-slit envelope entering the vacuum zone.

In FIG. 1, the preferred embodiment of envelope handling system 20 of the present invention is shown. As depicted therein, envelope handling system 20 comprises an envelope transfer belt 22, an envelope support plate 31, and pinch rollers 32 and belts 33, all of which cooperate to automatically transfer envelopes 26 in the direction of arrow 21. After being slit along the top and side edges thereof, envelope 26 passes between vacuum manifolds 23 and 24 for separating the sides of the envelope from the contents thereof. Envelope 26 is then passed through a content removal zone until reaching sensor control assembly 30.

Figure 2:
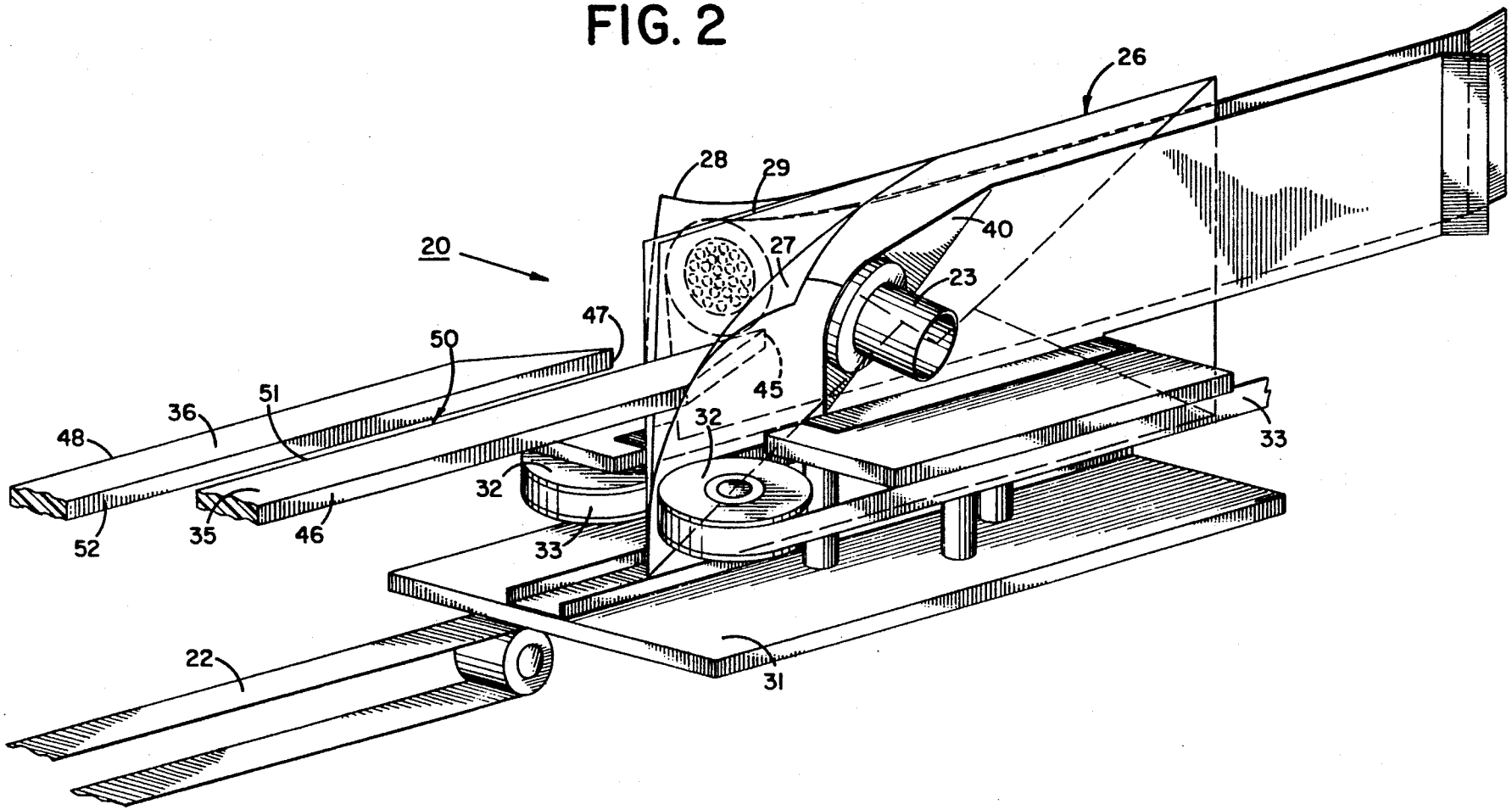
FIGS. 2 and 3 are perspective views, partially broken away, of the vacuum zone portion of the envelope handling system of FIG. 1, showing different stages of the envelope's advance therethrough.
Figure 3:
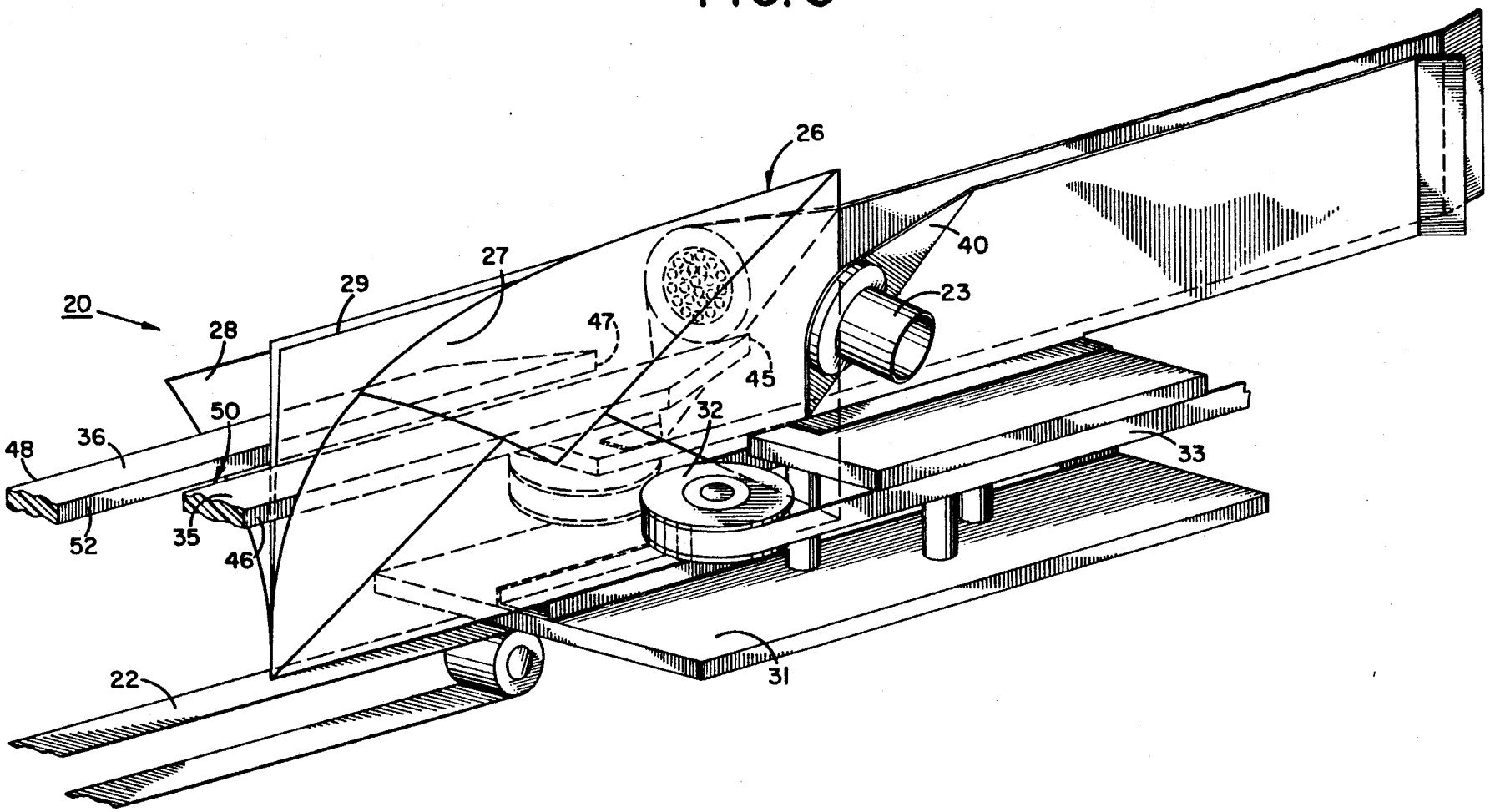

As shown in FIGS. 1–3, envelopes 26 each comprise side surfaces 27 and 28 and incorporate envelope contents 29. As pre-slit envelope 26 advances into juxtaposed spaced relationship with vacuum manifold 23, side 27 of envelope 26 is drawn towards manifold 23, while side 28 of envelope 26 remains substantially perpendicular to support plate 31. Shortly thereafter, side 28 of envelope 26 is brought into juxtaposed, spaced relationship with vacuum manifold 24, thereby causing side 28 of envelope 26 to be drawn thereto. In this way, envelope sides 27 and 28 are separated, leaving the envelope contents 29 substantially perpendicular to plate 31. In order to assure that this position is maintained and enable the operators to remove contents 29 from envelope 26, separator tracks 35 and 36 are employed.

Figure 4:
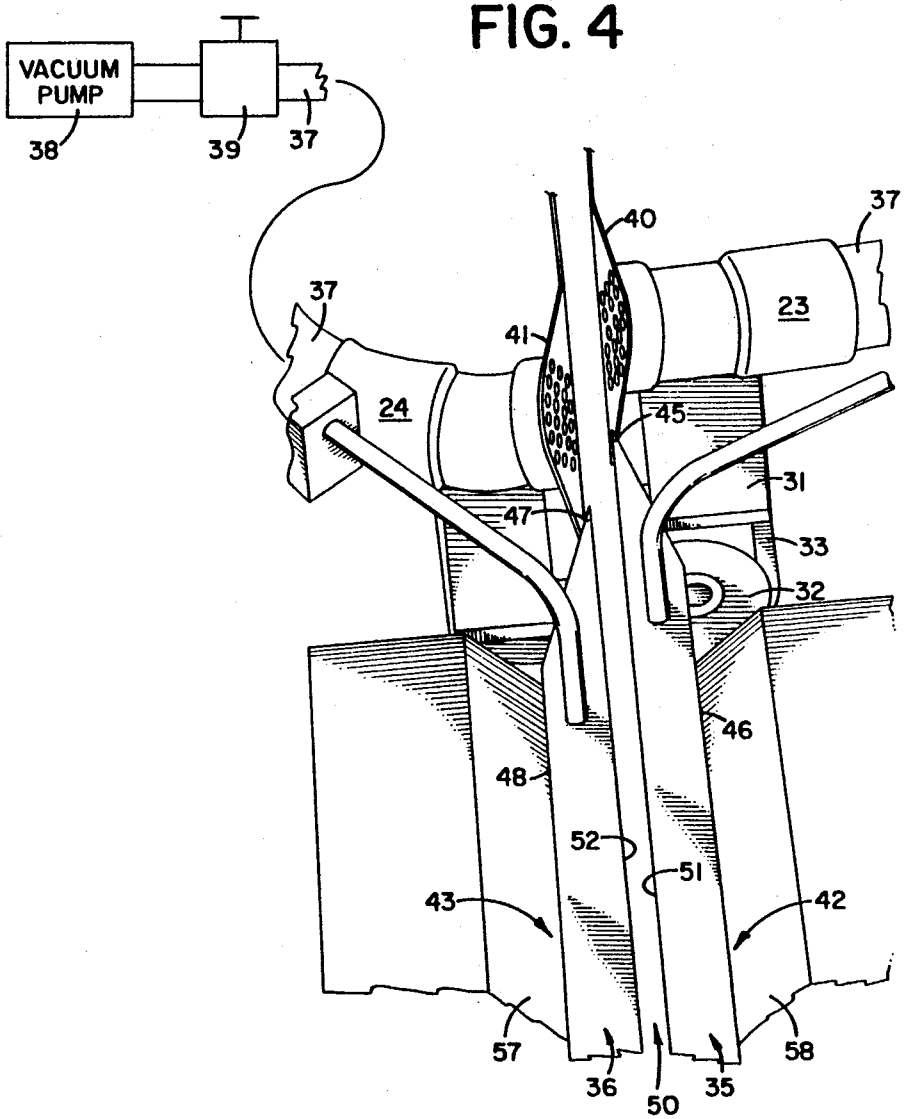
FIG. 4 is a top plan view of the vacuum zone of the envelope handling system of the present invention.

In FIG. 4, the preferred embodiment for the vacuum manifold construction of the present invention is most clearly depicted. As shown therein, manifolds 23 and 24 are both connected to a vacuum source 38 in order to provide the precisely desired vacuum level at the inlet portal of both manifolds 23 and 24. As shown therein, tubing 37 extends from both manifolds 23 and 24 directly to a vacuum source 38. In addition, vacuum source 38 also incorporates adjustment means 39 which allows the level of the vacuum at the inlet portals of manifolds 23 and 24 to be precisely adjusted by the operator, thereby precisely controlling and providing the most efficient vacuum level.

In the preferred embodiment, the inlet to vacuum manifold 23 is formed in a face plate 40 which incorporates a plurality of inlet holes formed therethrough. Similarly, vacuum manifold 24 is mounted to a face plate 41, which comprises a plurality of inlet holes therein and provides the vacuum inlet for manifold 24.

In the present invention, vacuum manifolds 23 and 24 are both positioned in juxtaposed spaced relationship, with the central axis of each vacuum manifold 23 and 24 being horizontally spaced apart from each other. In this way, an envelope being transferred along plate 31 is brought into juxtaposed spaced relationship with manifold 23 prior to the opposed side thereof being brought into spaced relationship with manifold 24. It has been found that this construction is extremely important in assuring repeatable, efficient and dependable envelope separation, while avoiding having the contents of the envelope also drawn to the vacuum source.

In order to provide the most efficient, optimum operation of the present invention, vacuum manifolds 23 and 24 are spaced apart a distance of at least one inch, up to a distance of about four inches. Although this separation range has been found to provide an efficient operation, it has also been found that a spacing of between about two inches to three inches is most desirable, assuring repeatable, consistent envelope separation without adversely affecting the contents of the envelope.

In addition to the staggered, spaced distance between the central axis of vacuum manifolds 23 and 24, it has also been found that the planar portion of face plate 40 which comprises the inlet ports of manifold 23 is preferably mounted at an acute angle to the vertical plane in which envelope 26 initially travels. In the preferred embodiment, the acute angle is formed to place the inlets to manifold 23 closest to the envelope entry zone. In this way, the vacuum source is closest to envelope 26 as envelope 26 is brought into juxtaposed spaced relationship with face plate 40 and manifold 23, causing side 27 of envelope 26 to be drawn to plate 40, while also staying with and being transferred along face plate 40, conforming to the diverging angle thereof as envelope 26 advances. In this way, side 27 of envelope 26 is efficiently and effectively separated from the remaining envelope and contents.

As shown in FIG. 4, portal bearing face plate 41 is constructed in a substantially identical manner as described above, having an acute angle relative to the vertical plane of envelope 26. However, face plate 41 is positioned on the opposite side of the envelope plane, with its acute angle diverging from the vertical plane in the opposed direction.

As shown in FIGS. 1-3, by employing this construction, as envelope 26 enters juxtaposed spaced relationship with vacuum manifold 23 side 27 thereof is drawn towards manifold 23 and is brought into sliding frictional engagement with portal bearing face plate 40. As the envelope advances, side 27 of envelope 26 remains in engagement with face plate 40, until it contacts the leading edge of separator track 35, thereby assuring that side 27 of envelope 26 is firmly positioned in the desired orientation.

After envelope 26 has been brought into contact with face plate 40 of vacuum manifold 23, the opposed side 28 of envelope 26 is drawn into engagement with face plate 41 of vacuum manifold 24. As envelope 26 advances further along its substantially vertical plane, side 28 of envelope 26 remains in sliding frictional engagement with face plate 41 of vacuum manifold 24 until being captured by the opposed separator track 36 and retained in its precisely desired orientation.

In addition to having the substantially planar surface of portal bearing face plates 40 and 41 positioned at an angular slant relative to the vertical plane within which envelope 26 advances, the substantially planar portal bearing face plates 40 and 41 are also positioned in an angular tilt away from the plane in which envelope 26 passes, with the angular tilt being slanted away from the plane as one moves upwardly from plate 31. It has been found that by employing this compound angular surface construction for portal bearing face plates 40 and 41, optimum separation of the envelope sides is obtained, while a minimum amount of vacuum force is required. In particular, it has been found that by positioning portal bearing face plates 40 and 41 in close proximity to the vertical plane in which envelope 26 passes as envelope 26 advances into juxtaposed spaced relationship with vacuum manifolds 23 and 24, the sides of the envelopes are drawn towards their respective vacuum manifolds and then consistently, repeatedly and dependably maintained in frictional engagement with face plates 40 and 41 as the envelope advances along its transfer path.

In the preferred embodiment, it has been found that both portal bearing face plates 40 and 41 comprise a slant angle relative to a vertical plane defined by envelope 26 which is equal to about 10°, with the angle of tilt away from the plane, also comprises about 10°. Although these angles can vary to between about 5° and 15°, it has been found that both of these angles should comprise about 10° for optimum efficacy.

In typical operation, envelope 26 is pre-slit prior to being transferred to envelope handling system 20 of this invention. As shown in FIGS. 1-3, as pre-slit envelope 26 advances toward vacuum manifold 23, side 27 of envelope 26 is brought into juxtaposed spaced relationship with the leading edge of portal bearing face plate 40. As the vacuum forces act upon envelope side 27, the leading edge of side 27 is drawn into frictional engagement with portal bearing face plate 40.

As envelope 26 advances further along plate 31 by rollers 32 and belt 33, side 27 of envelope 26 remains in sliding frictional engagement with the surface of portal bearing face plate 40, due to the vacuum force acting thereon. As envelope 26 advances, the remainder of side 27 is continuously drawn away from the vertical plane within which envelope 26 originally was presented, due to the compound, slanting and tilting angle imposed upon portal defining face plate 40.

As side 27 of envelope 26 continues to be drawn further away from the vertical plane defined by the original envelope position, the leading edge of side 27 of envelope 26 passes tip 45 of separator track 35, causing side 27 of envelope 26 to be captured by edge 46 of track 35, in envelope side channel 42. In this way, side 27 of envelope 26 is maintained in the desired, spaced, separated orientation from the remainder of envelope 26.

As side 27 passes along in frictional contact with portal bearing face plate 40 of vacuum manifold 23, side 28 of envelope 26 comes into juxtaposed spaced facing relationship with the leading edge of portal bearing face plate 41 of manifold 24. In a similar manner as described in reference to manifold 23, vacuum manifold 24 draws envelope side 28 into contact with portal bearing face plate 41, maintaining envelope side 28 in sliding frictional engagement with face plate 41 as envelope 26 advances on plate 31.

Side 28 is drawn away from the vertical plane of original envelope 26 due to the angular slant and angular tilt of portal bearing face plate 41 of vacuum manifold 24. Once envelope 28 has been drawn away from the vertical plane of the original envelope position and has slid across substantially the entire portal bearing face plate 41, the leading edge of envelope side 28 passes tip 47 of separator track 36, thereby maintaining side 28 of envelope 26 in the precisely desired, securely separated position in channel 43, held in that position by edge 48 of track 36.

As best seen in FIGS. 1–4, with envelope sides 27 and 28 separated from each other and maintained in the separated position by tracks 35 and 36 and in their respective channels 42 and 43, envelope contents 29 continues to be transmitted along the vertical plane perpendicular to transfer belt 22, with envelope contents 29 positioned in the precisely desired location in channel 50, defined by edge 51 of track 35 and edge 52 of track 36. In this way, any envelope entering envelope handling system 20 of the present invention is consistently and repeatedly separated, with both sides thereof being dependably drawn in opposite directions, while the envelope contents are consistently and repeatedly transferred along in the precisely desired envelope contents channel 50 for removal and processing. By employing this invention, it has been found that dependable, consistent and repeatable envelope handling capabilities are attained, with every pre-slit envelope having both sides separated efficiently and effectively, with the envelope contents being consistently transmitted through the contents handling channel precisely as desired.

In most operations, an operator is stationed in zone 25 and removes contents 29 of the envelope as contents 29 is transmitted through channel 50. In addition, the operator visually checks to be certain no document has been erroneously positioned in envelope side channels 42 or 43. With the contents removed for processing, the envelope itself passes sensor control assembly 30 and is then transferred to a waste collection zone.

In order to be certain that operator error does not result in loss of material which should be processed, some prior art systems have incorporated sensors for assuring either the presence or absence of the contents during passage by a particular check zone. As shown in FIG. 1, the sensors check to be certain that no envelope contents has erroneously remained in channel 50 as the envelope passes by sensor control assembly 30 for subsequent disposal of the envelope. By employing this prior art sensor system, no envelope contents are erroneously thrown away.

Although prior art sensor control systems have enabled system users to know that the envelope contents has not been completely removed prior to having the envelope pass to waste disposal, no prior art system has provided any control means for assuring that part of the envelope contents is not erroneously affixed to a side of the envelope and maintained in that position either by edge 46 of track 35 or edge 48 of track 36. If this condition exists and is not observed by the operator, this material is lost and thrown away, along with envelope 26.

In order to eliminate this potential problem, the present invention incorporates a sensor control assembly 30 which separately analyzes each side of every envelope to determine the presence or absence of any additional information or material. In this way, the prior art difficulties and drawbacks of wanted material being accidentally thrown away is completely eliminated.

Figure 5:
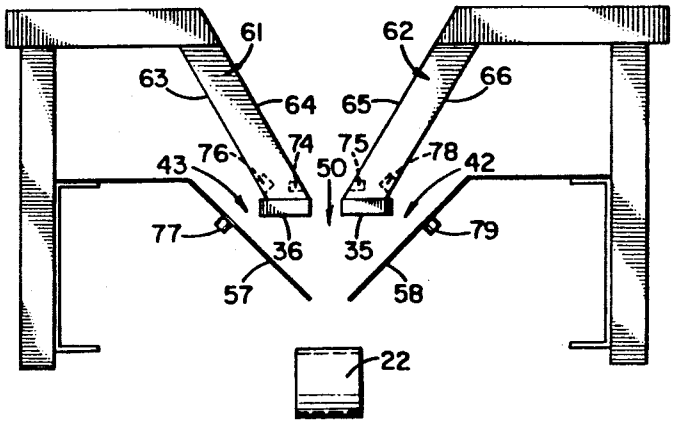
FIG. 5 is a cross-sectional side elevation view of the sensor control assembly of the envelope handling system.

In FIGS 1 and 5, the preferred construction for sensor control assembly 30 is shown in detail. In this preferred embodiment, sensor control assembly 30 incorporates a display panel 60 which is connected to support arms 61 and 62. Support arm 61 incorporates side surfaces 63 and 64, while support arm 62 incorporates side surfaces 65 and 66.

As clearly shown in FIGS. 1 and 5, side surfaces 64 and 65 of support arms 61 and 62 are in juxtaposed spaced facing relationship forming the upper portion of envelope transfer zone 50. In addition, side surface 63 of support arm 61 is in juxtaposed spaced facing relationship with support wall 57 of envelope handling system 20, cooperating with edge 48 of track 36 to define transfer zone 43 for side 28 of envelope 26. Similarly, side 66 of support arm 62 is in juxtaposed spaced facing relationship with support wall 58 of envelope handling system 20 cooperating with edge 46 of track 35 to define transfer zone 42 for side 27 of envelope 26.

Panel 60 of sensor control assembly 30 incorporates a plurality of LED's 69 which form a control and information display. In addition, panel 60 also incorporates sensitivity control knobs 70 and 71, which provide the desired controlled adjustability to directly determine the presence or absence of unwanted material associated with sides 27 or 28 of envelope 26.

Although any desired sensing means can be employed, in the preferred embodiment, sensor control assembly 30 incorporates a plurality of photo-detectors and light sources for determining the presence or absence of material passing between side surfaces 64 and 65 of support arms 61 and 62, as well as the presence of material passing between side 63 of support arm 61 and support wall 57. In addition, a photo-detector and light source is also directly associated with side 66 of support arm 62 and support wall 58.

In the preferred embodiment, a photo-detector 74 is mounted in side 64 of support arm 61 in juxtaposed spaced cooperating relationship with light source 75 formed in side 65 of support arm 62. Photo-detector 74 and light source 75 provide an output signal whenever the presence of the envelope contents is sensed. Typically, this signal provides an alarm condition and automatically stops the movement of transfer belt 22.

In addition to sensing the presence of material in contents transfer channel 50, sensor control assembly 30 of the present invention also directly senses the presence of side 27 and 28 of envelope 26 and also determines whether any additional material is associated with sides 27 or 28.

In the preferred embodiment, a photo-detector 76 is mounted in side 63 of support arm 61 in juxtaposed spaced cooperating relationship with light source 77 mounted in support wall 57, thereby spanning transfer zone 43. Similarly, a photo-detector 78 is mounted in side 66 of support arm 62 in juxtaposed spaced cooperating relationship with light source 79 mounted in support wall 58, spanning transfer zone 42.

In the preferred embodiment, in addition to sensing the presence of the envelope side passing between the photo-detectors and light sources, photo-detectors 76 and 78 are adjustable to provide an effective thickness control measurement. By positioning side 28 of envelope 26 between photo-detector 76 and light source 77 and employing adjustment knob 70, the system effectively reads the thickness of envelope side 28. Similarly, knob 71 is employed by the operator to adjust the sensitivity of light source 79 and photo-detector 78 to sense the thickness of envelope side 27.

In this way, the thickness of envelope sides 27 and 28 is precisely recognized and no alarm condition results when only sides 27 or 28 pass sensor control assembly 30. In this way, sides 27 and 28 of envelope 26 are continuously monitored and freely pass along their transfer channels without any alarm condition being signalled when only the envelope sides 27 and 28 are present.

If, however, material which should be processed, such as a check, a statement, or note, has been inadvertently attached to either side 27 or side 28 of envelope 26, and not observed by the operator, either light source 77 or 79 will be unable to transfer its signal to photo-detector 76 or 78 due to the added thickness of material passing therebetween. Whenever such a condition exists, an alarm signal is produced and transfer belt 22 is automatically stopped.

As is apparent from this detailed disclosure, sensor control assembly 30 efficiently provides an automatic sensing system for determining the presence of envelope content material erroneously associated with either side of the envelope being processed. In this way, any operator error in failing to observe such a condition is automatically and efficiently recognized without causing detrimental separation of this material from the remaining contents of the envelope. As a result, the present invention attains a fool-proof, fully automated transfer system wherein unwanted disassociation of the envelope contents is completely eliminated.

Figure 6:
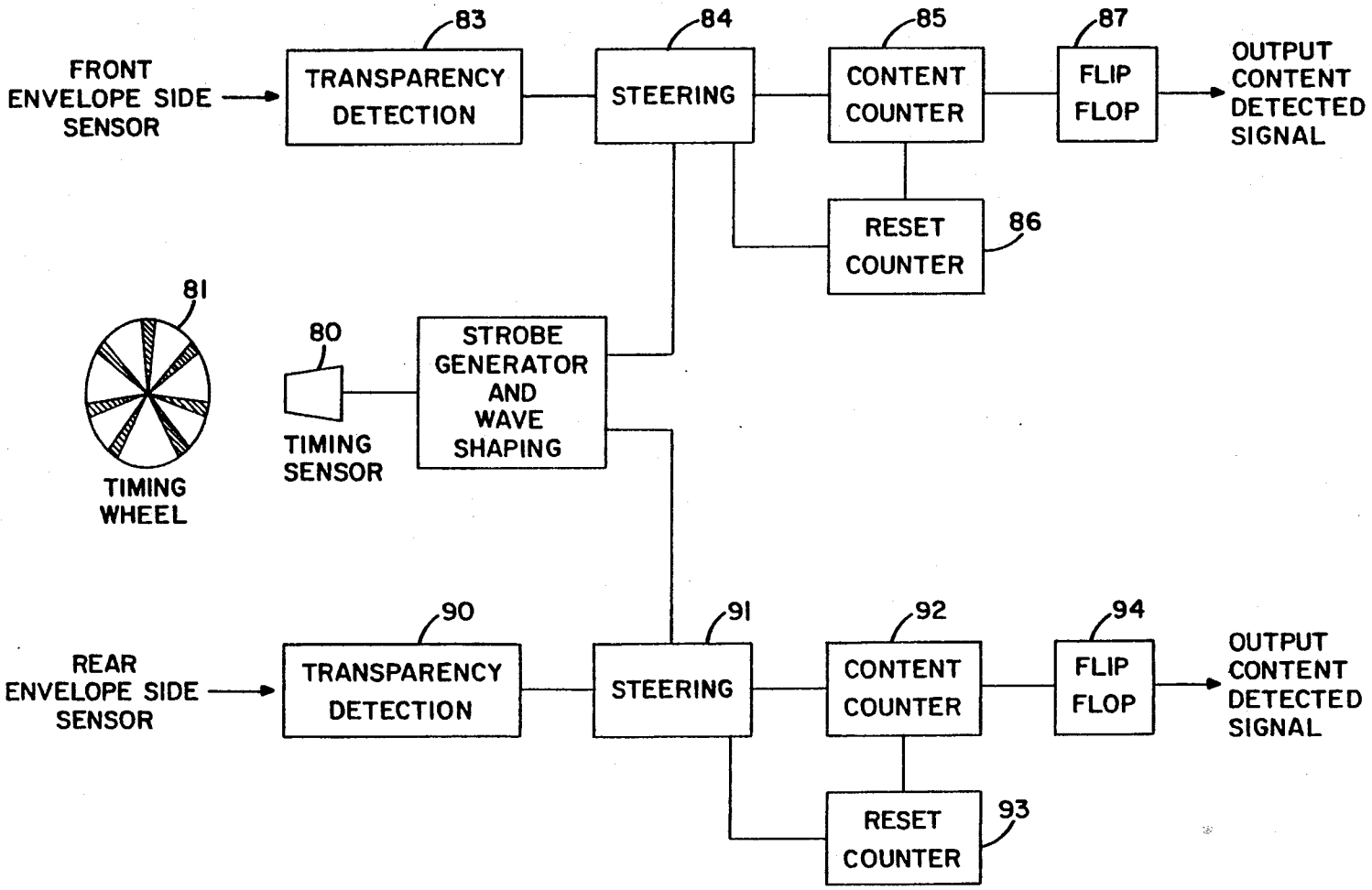
FIG. 6 is a schematic block diagram of the sensor control assembly of the envelope handling system of the present invention.

In FIG. 6, a schematic block diagram for sensor control system 30 is provided. As shown therein, the functional block diagram for the envelope thickness sensors is detailed. Furthermore, the timing sequence for assuring an error-free control system is provided.

Due to the variations in envelope feeding speeds and variable stop positions at the sensing zones, the conventional detection methods give false detection signals when the feeding speed is varied or stopped, or when construction seam or dark printing is stopped at the detecting sensor. To prevent this type of false detection from occurring, the present invention employs a timing sensor 80 to generate strobe pulses corresponding to the envelope feeding speed. The strobe pulses are directed to either content counter 85 and 92 or the reset counter 86 and 93 depending on contents being detected.

When envelope contents is detected, the strobe pulses are directed to the content counter 85 and 92. The number of pulses counted represents the length of the content being detected. When no contents is detected, the strobe pulses are directed to reset counter 86 and 93.

As more fully detailed below, the number of counts determines whether actual envelope contents has been detected. Furthermore, the pulses are counted separately. If the feeding speed is slow, the strobe pulses will be generated less frequently. In essence, the detection is made repeatedly only at a predetermined strobing time on the envelope. Therefore, the speed change will not elongate or shorten the image being sensed by the sensor.

The strobe pulse is generated by the sensor 80 by reading the timing mark placed on the envelope feeding pulley or timing wheel 81. The strobe generator and wave shaping circuit reconditions the waveform and feeds the signal to the front and rear steering circuit 84 and 91 for content detection.

Figure 7:
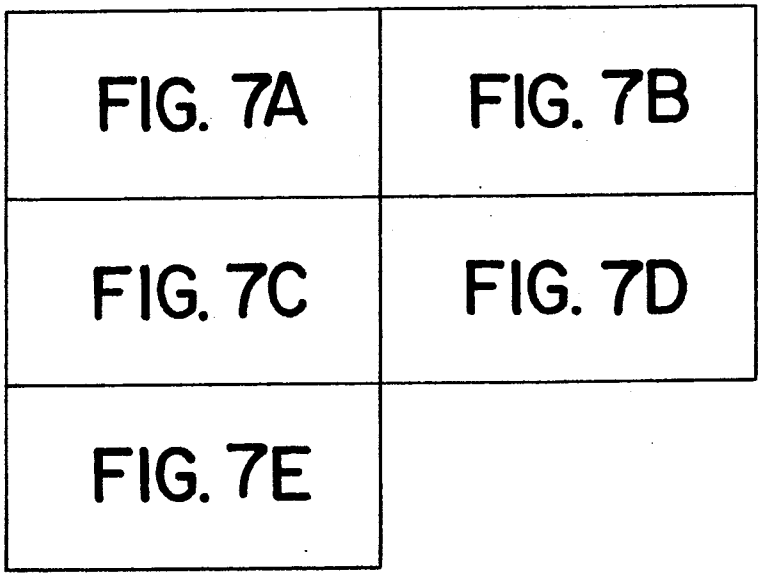
FIG. 7, which is composed of FIGS. 7A and 7E, is a detailed schematic diagram of the electronic assembly of the sensor control assembly of the present invention.
Figure 7A:
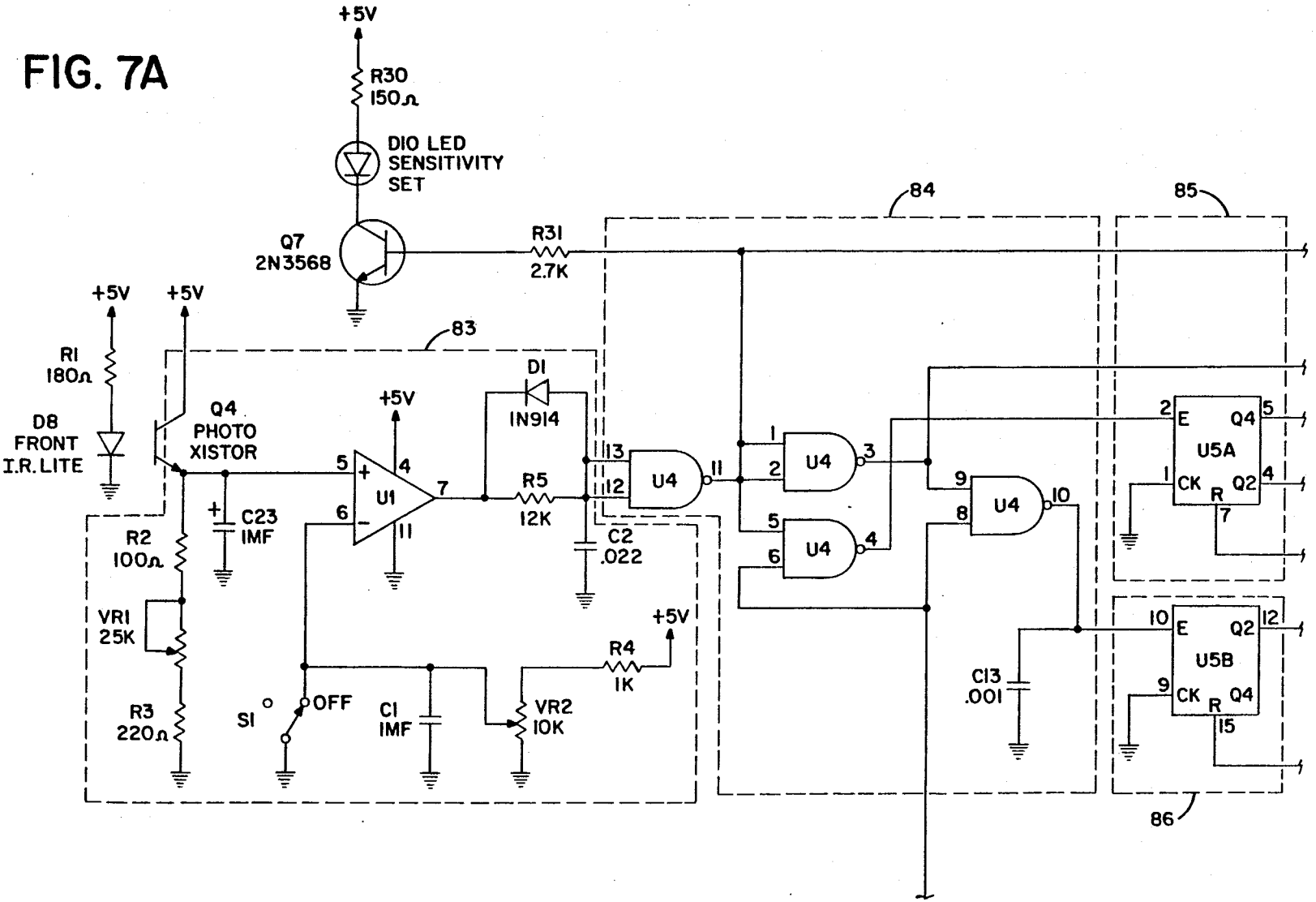
Figure 7B:
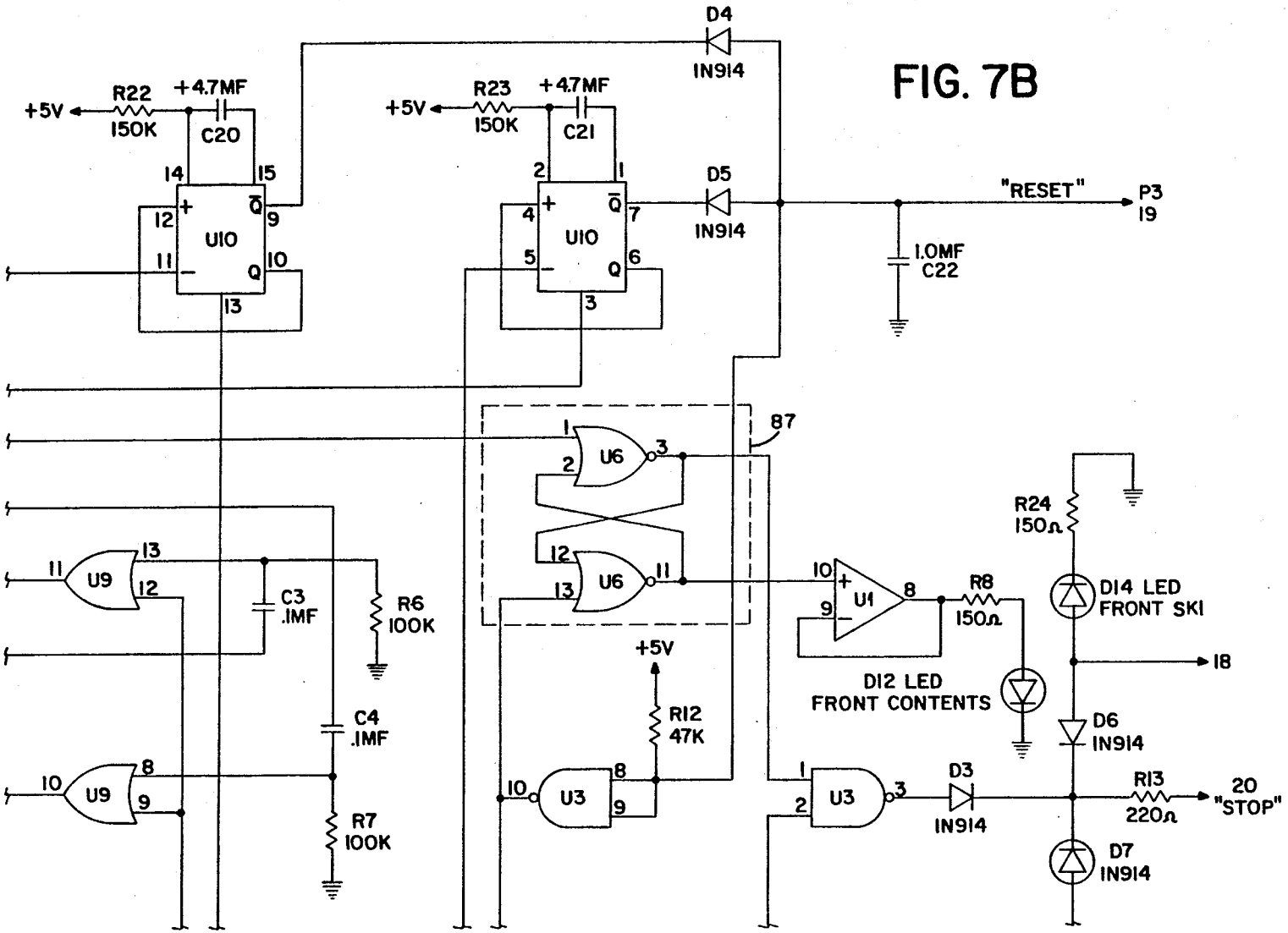
Figure 7C:
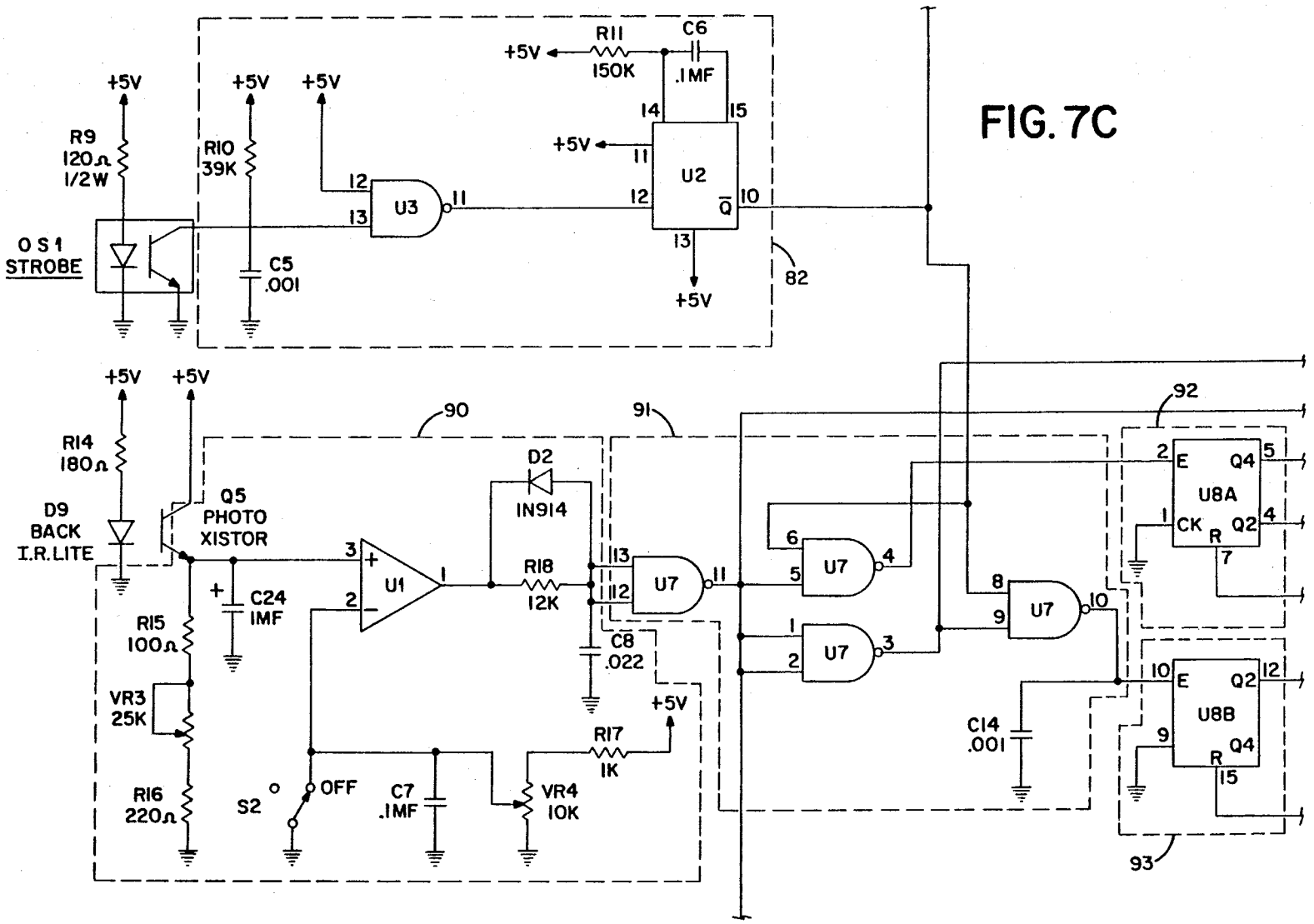
Figure 7D:
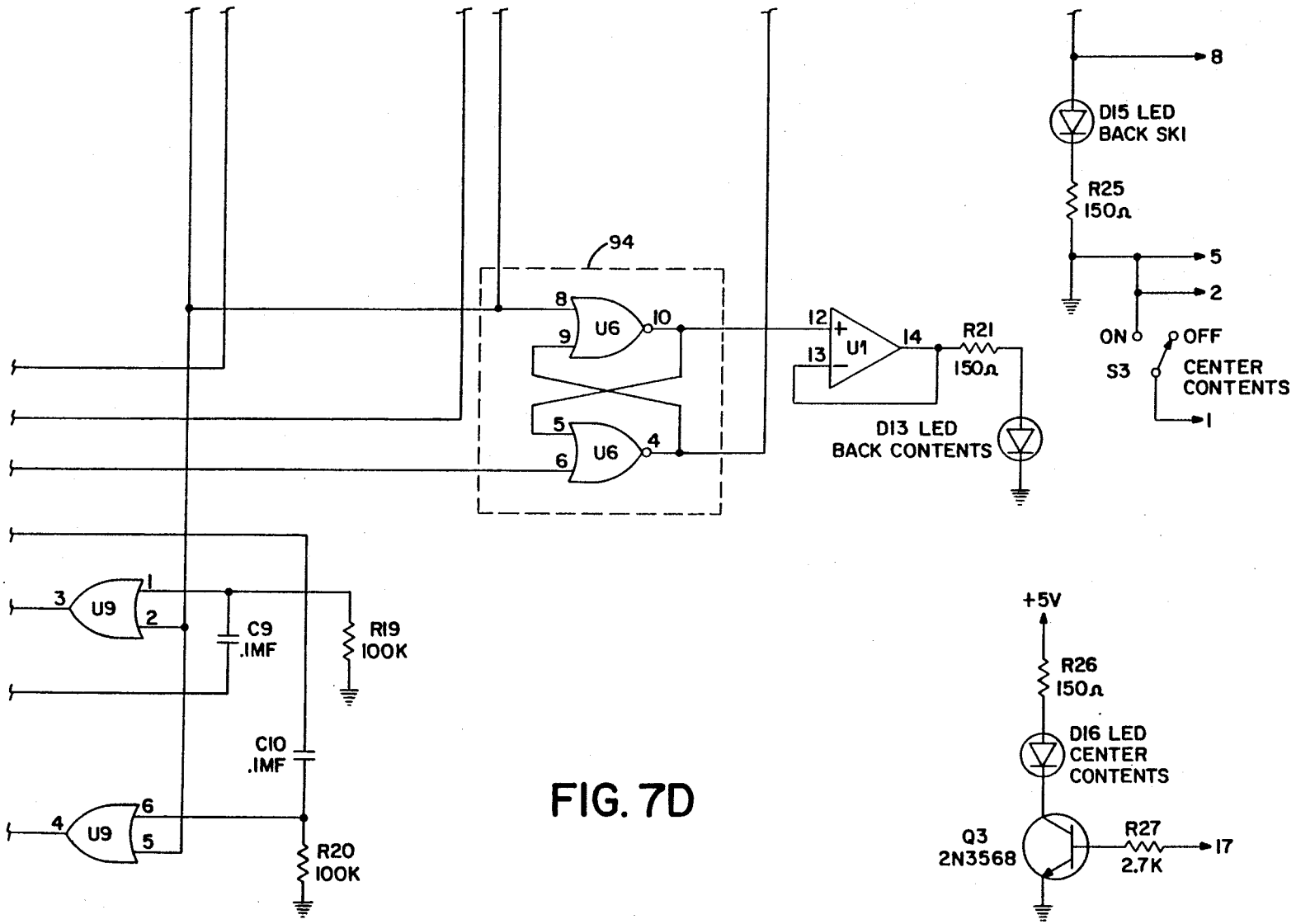
Figure 7E:
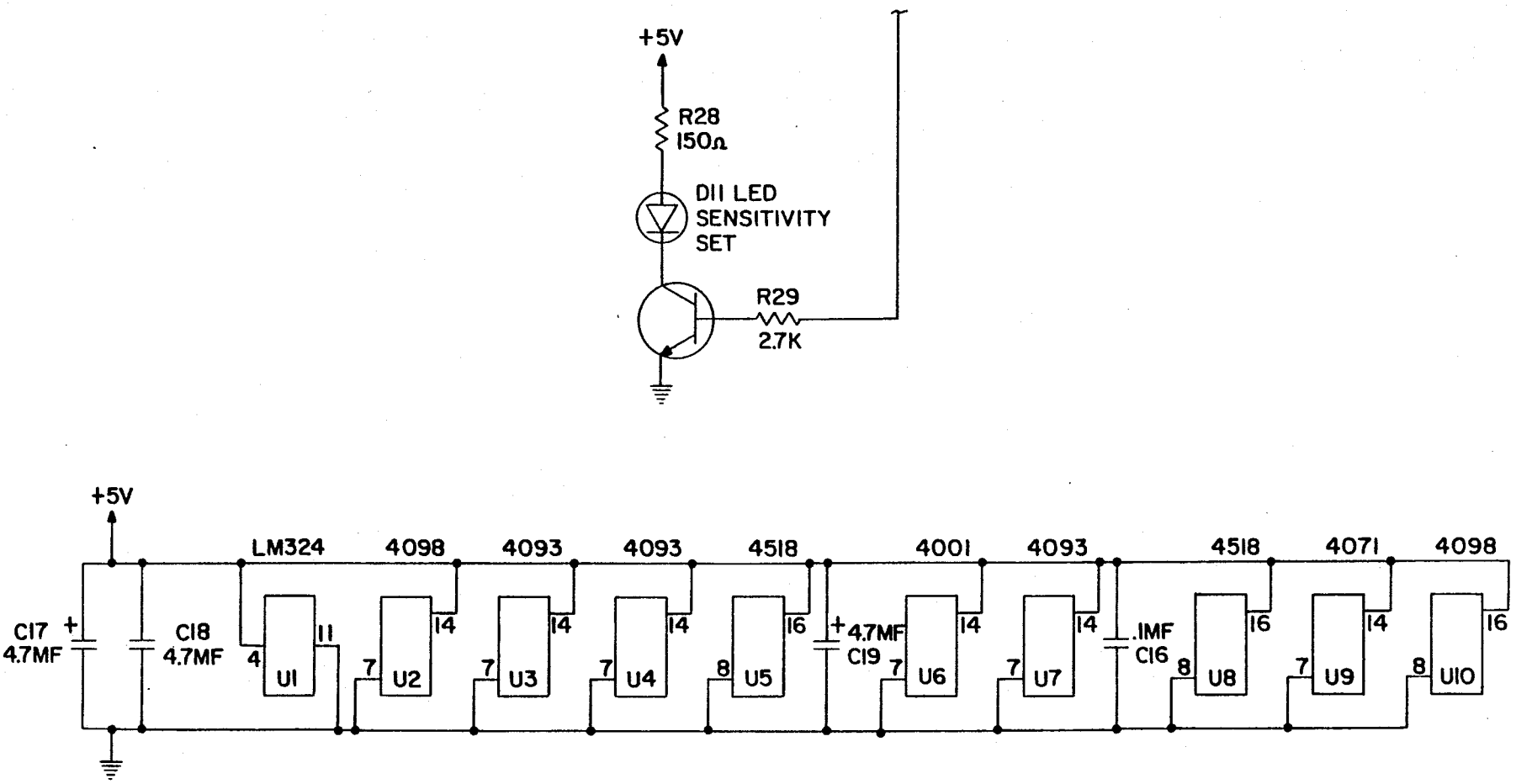

The sensitivity of the front envelope side sensor is adjusted in the transparency detection circuit 83. As shown in FIG. 7, transparency detection circuit 83 adjusts the sensor sensitivity by VR1 which is fed to U1 at pin 5. The level detector U1 at pins 5, 6, and 7 compares the input signal at pin 5 with the threshold level set at pin 6 by VR2. Output pin 7 goes high when contents are being detected.

The U4 gates form the steering circuit 84. When contents are detected, the strobe pulses will output through U4 pin 4 to content counter U5A input U5 pin 2. When no contents are detected, the strobe pulses will be steered through U4 pin 10 to reset counter U5B input at U5 pin 10.

When no contents are being detected, the reset counter U5B will receive all the strobe pulses. As shown in FIG. 7, the output Q2 (U5 pin 2) will go high to reset the content counter (through U9 pin 13, pin 11 to U5 pin 7) every two strobe pulses counted by the reset counter. When contents are being detected, the strobe pulses will be counted by content counter U5A. If the content counter reaches 4, the output Q4 (U5 pin 5) will be high to indicate content in the envelope is detected.

The construction seam or dark printing is usually less than 3 strobe pulse periods in length. In the case where the length of the construction seam is equal to 3 or less strobe pulse periods in length, and is detected by the content counter described above, followed by two counts of the strobe pulses in the reset counter as described above, then the 3 (or less) counts in the content counter will be cleared. Therefore, repeated construction seams will not set off the detection. In a similar manner, a void (light spot or hole) in a content being detected will not escape the detection. These parameters may be altered by changing the count output of the counters being used.

A latch circuit 87 is used to retain the signal and feed it into the envelope feeding control circuit to stop the envelope drive and turn on the indicator as shown in FIGS. 6 and 7. The same circuit is duplicated for detecting the other side of the envelope.

As shown in FIGS. 6 and 7, the rear envelope sensor is arranged in the identical manner described above. In this way, complete, controlled sensing of both envelope sides is efficiently and effectively attained.

It will be thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. An envelope handling system for receiving pre-slit content-bearing envelopes, separately displaying each of the envelope sidewalls and the contents of the envelope in independent planes, thereby enabling the efficient removal of the contents from the envelope, while also assuring that all of the contents has been removed prior to discarding the envelope, the system comprising:

A. envelope transfer means for automatically advancing the envelope through the system;

B. an envelope and contents processing zone comprising channel-defining means forming three independent, substantially parallel, longitudinally extending transfer planes for separately and simultaneously accommodating one of the following in one of said planes a. the contents of the envelope, b. a first sidewall of the envelope, and c. a second sidewall of the envelope;

C. a first detector a. mounted in association with the transfer plane of the first sidewall of the envelope, and b. comprising a first pair of sensor means mounted in juxtaposed, spaced, cooperating relationship on opposed sides of the first envelope sidewall transfer plane for independently sensing the first envelope sidewall to determine the presence of material in addition to the first sidewall; and D. a second detector a. mounted in association with the transfer plane of the second sidewall of the envelope, and b. comprising a second pair of sensor means mounted in juxtaposed, spaced cooperating relationship on opposed sides of the transfer plane of the second envelope sidewall for independently sensing the second envelope sidewall to determine the presence of material in addition to the second sidewall whereby a highly effective and efficient envelope separation system is attained which virtually eliminates mishandling of the contents by automatically sensing the presence of any material in addition to the sidewall prior to discarding the envelope.

2. The envelope handling system defined in claim 1, wherein said system further comprises:

E. a third detector a. mounted in association with the transfer plane of the contents, and b. comprising a third pair of sensor means mounted in juxtaposed, spaced, cooperating relationship on opposed sides of the contents containing transfer plane for automatically sensing the presence of the contents in said transfer plane at a position after removal thereof should have been achieved, whereby the presence of any contents not removed from said transfer plane is automatically sensed.

3. The envelope handling system defined in claim 2, wherein each of said detectors is further defined as providing an output signal for transmission to the envelope transfer means for stopping movement of the transfer means any time additional material is sensed in association with the side wall of the envelope and any time the presence of the envelope contents is sensed after removal thereof should have been completed.

4. The envelope handling system defined in claim 1, wherein each of said detectors is further defined as comprising electro-optical sensors.

5. The envelope handling system defined in claim 4, wherein each of said detectors is further defined as being adjustable for controlling a threshold of the output signal to assure that envelopes of varying thickness and color are easily accommodated.

6. The envelope handling system defined in claim 1, wherein each of said detectors is further defined as comprising:

a. a photo-detector forming one of said pair of sensor means and mounted on a first side of the transfer plane, b. a variable intensity light source forming another of said pair of sensor means and mounted on a second side of the transfer plane in juxtaposed, spaced, cooperating relationship with the photo-detector, c. control means connected to the light source for adjustably varying the intensity of the light source to enable the light source to be sensed by the photo-detector when the envelope sidewall passes therebetween, d. means for generating a contents alert signal whenever the photo-detector fails to receive an output from the light source, and e. alarm means responsive to the contents detected signal for initiating an alarm signal, whereby sensor means are achieved which are adjustable for the light source transmission property of envelopes being processed, thereby assuring the initiation of an alarm signal only when material in addition to the envelope sidewall passes between the photo-detector and the cooperating light source.

7. The envelope handling system defined in claim 6, wherein said alarm means is further defined as comprising 1. an audible and visual signalling device for indicating that material in addition to the envelope sidewall has been detected, and 2. means for stopping the passage of the envelope through the transfer zone, whereby a signal is immediately provided when the presence of additional material has been sensed and the entire system is stopped in order to enable the removal of the additional material, prior to final discarding of the envelope.

8. The envelope handling system defined in claim 6, wherein the transfer means advances the envelope and contents at a substantially fixed speed and said system further comprises:

E. timing means mounted in cooperating relationship with the envelope transfer means and constructed for a. measuring a speed of the transfer means, b. producing an output signal corresponding to the transfer means speed, and c. transmitting said output signal to the first and second detectors for use in eliminating false readings due to variations in the speed of the transfer means.

9. The envelope handling means defined in claim 6, wherein the transfer means advances the envelope and contents at a substantially fixed speed and said system further comprises:

E. timing means mounted in cooperating relationship with the envelope transfer means and comprising
  a. a timing wheel
    1. incorporating a plurality of timing marks formed thereon, and
    2. movably connected to the transfer means for alternatingly presenting said timing marks to a timing sensor in direct relationship to a speed of the transfer means, and
  b. a timing sensor assembly
    1. fixedly mounted in juxtaposed, spaced cooperating relationship with the timing wheel, and
    2. constructed for generating and transmitting a timing pulse for every timing mark sensed.

10. The envelope handling system defined in claim 9, wherein said system further comprises
E. signal processing means constructed for
  a. receiving the contents alert signal from the detectors and the timing pulses from the timing sensor assembly,
  b. storing the contents alert signal while simultaneously counting the timing pulses, and
  c. outputting a contents detected alarm signal in response to the presence of a contents alert signal for a predetermined number of timing pulses.

11. The envelope handling system defined in claim 10, wherein the signal processing means is further defined as comprising
d. a first counter for receiving a pre-set number of timing pulses and generating a reset signal in response thereto,
e. a second counter
  1. constructed for receiving and storing a predetermined plurality of timing pulses,
  2. generating an output signal when the second counter has been filled, and
  3. responsive to a reset signal from the first counter for clearing and re-starting the storing of the timing pulses, and
f. a signal steering circuit constructed for
  1. receiving the timing pulses and the contents alert signal,
  2. normally transmitting the timing pulses to the first counter, and
  3. redirecting and transmitting the timing pulses to the second counter only when the contents alert signal is detected.

12. The envelope handling system defined in claim 11, wherein the second counter is further defined as being constructed for generating an output signal when four timing pulses have been stored.

13. The envelope handling system defined in claim 11, wherein the envelope transfer means is further defined as advancing the envelope at a rate of speed which will cause substantially all construction seams of the envelope to pass the sensor means within the time required for the timing means to generate three timing pulses.

14. The envelope handling system defined in claim 11, wherein the first counter is further defined as generating a reset signal in response to the receipt of two timing signals.

15. An envelope handling system for receiving preslit content-bearing envelopes, separately displaying each of the envelope sidewall and the contents of the envelope in independent planes, thereby enabling the efficient removal of the contents from the envelope, while also assuring that all of the contents has been removed prior to discarding the envelope, the system comprising:
A. envelope transfer means for automatically advancing the envelope through the system at a substantially fixed speed;
B. an envelope and contents processing zone comprising channel-defining means forming three independent, substantially parallel, longitudinally extending transfer planes for separately and simultaneously accommodating one of the following in one of said planes
  a. the contents of the envelope,
  b. a first sidewall of the envelope, and
  c. a second sidewall of the envelope;
C. a first detector
  a. mounted in association with the transfer plane of the first sidewall of the envelope, and
  b. comprising a first pair of sensor means mounted in juxtaposed, spaced, cooperating relationship on opposed sides of the first envelope sidewall transfer plane for independently sensing the first envelope sidewall to determine the presence of material in addition to the first sidewall, the first pair of sensor means comprising
    1. a photo-detector mounted on a first side of the transfer plane of the first sidewall of the envelope,
    2. a variable intensity light source mounted on a second side of the transfer plane of the first sidewall of the envelope in juxtaposed, spaced, cooperating relationship with the photo-detector,
    3. control means connected to the light source for adjustably varying the intensity of the light source to enable the light source to be sensed by the photo-detector when the envelope sidewall passes between said first pair of sensor means,
    4. means for generating a contents alert whenever the photo-detector fails to receive the output from the light source, and
    5. alarm means responsive to the contents detected signal for initiating an alarm signal,
D. a second detector
  a. mounted in association with the transfer plane of the second sidewall of the envelope, and
  a. mounted in association with the transfer plane of the second sidewall of the envelope, and
  b. comprising a second pair of sensor means mounted in juxtaposed, spaced cooperating relationship on opposed sides of the transfer plane of the second envelope sidewall for independently sensing the second envelope sidewall to determined presence of material in addition to the second sidewall, said second pair of sensor means comprising
    1. a photo-detector mounted on a first side of the transfer plane of the second sidewall of the envelope,
    2. a variable intensity light source mounted on a second side of the transfer plane of the second sidewall of the envelope in juxtaposed, spaced, cooperating relationship with the photo-detector,
    3. control means connected to the light source for adjustably varying the intensity of the light source to enable the light source to be sensed by the photo-detector when the envelope sidewall passes between said second pair of sensor means, 4. means for generating a contents alert signal whenever the photo-detector fails to receive an output from the light source, and 5. alarm means responsive to the contents detected signal for initiating an alarm signal, E. timing means mounted in cooperating relationship with the envelope transfer means and constructed for measuring the speed of the transfer means, producing a timing pulse signal corresponding to the transfer means speed, and transmitting said timing pulse signal to the first and second detectors for use in eliminating false readings due to variations in the speed of the transfer means and comprising a. a timing wheel 1. incorporating a plurality of timing marks formed thereon, and 2. movably connected to the transfer means for alternatingly presenting said timing marks to a timing sensor in direct relationship to the speed of the transfer means, and b. a timing sensor assembly 1. fixedly mounted in juxtaposed, spaced cooperating relationship with the timing wheel, and 2. constructed for generating and transmitting a timing pulse for every timing mark sensed; and F. signal processing means a. constructed for receiving the contents alert signal from the detectors and the timing pulses from the timing sensor assembly, b. storing the contents alert signal while simultaneously counting the timing pulses, c. outputting a contents detected alarm signal in response to the presence of a contents alert signal for a predetermined number of timing pulses, d. comprising a first counter for receiving a pre-set number of timing pulses and generating a reset signal in response thereto, e. a second counter 1. constructed for receiving and storing a predetermined plurality of timing pulses, 2. generating an output signal when the second counter has been filled, and responsive to a reset signal from the first counter for clearing and re-starting the storing of the timing pulses, and f. a signal steering circuit constructed for 1. receiving the timing pulses and the contents alert signal, 2. normally transmitting the timing pulses to the first counter, and 3. redirecting and transmitting the timing pulses to the second counter only when the contents alert signal is detected.

16. An envelope handling system for receiving preslit content-bearing envelopes, separately displaying each of the envelope sidewalls and the contents of the envelope in independent planes, thereby enabling the efficient removal of the contents from the envelope, while also assuring that all of the contents has been removed prior to discarding the envelope, the system comprising:

A. envelope conveyor transfer means for automatically advancing the envelope through the system at a substantially fixed speed; and B. timing means mounted in cooperating relationship with the envelope transfer means and comprising a. a timing wheel 1. incorporating a plurality of timing marks formed thereon, and 2. movably connected to the transfer means for alternatingly presenting said timing marks to a timing sensor in direct relationship to the speed of the transfer means, and b. a timing sensor assembly 1. fixedly mounted in juxtaposed, spaced cooperating relationship with the timing wheel, and 2. constructed for generating and transmitting a timing pulse for every timing mark sensed wherein the speed of movement of the envelope is measured to compensate for variations in at least envelope length.

17. The envelope handling system defined in claim 16, and further comprising:

C. first and second sensor means mounted in each of the envelope sidewall bearing transfer zones for independently sensing each envelope sidewall to determine the presence of any material in addition to the envelope sidewall, and D. signal processing means constructed for a. receiving the contents alert signal from the sensor means and the timing pulses from the timing sensor assembly, b. storing the contents alert signal while simultaneously counting the timing pulses, and c. outputting a contents detected alarm signal in response to the presence of a contents alert signal for a predetermined number of timing pulses.

18. The envelope handling system defined in claim 17, wherein the signal processing means is further defined as comprising d. a first counter for receiving a pre-set number of timing pulses and generating a reset signal in response thereto, e. a second counter 1. constructed for receiving and storing a predetermined plurality of timing pulses, 2 . generating an output signal when the second counter has been filled, and 3. responsive to a reset signal from the first counter for clearing and re-starting the storing of the timing pulses, and f. a signal steering circuit constructed for 1. receiving the timing pulses and the contents alert signal, 2. normally transmitting the timing pulses to the first counter, and 3. redirecting and transmitting the timing pulses to the second counter only when the contents alert signal is detected.

* * * * *